United States Patent [19]

Endruhn

[11] 4,343,237

[45] Aug. 10, 1982

[54] APPARATUS FOR MANUFACTURING CABLE HARNESSES AND PRINTER THEREFOR

[75] Inventor: Dieter Endruhn, Appel, Fed. Rep. of Germany

[73] Assignee: Messerschmitt-Boelkow-Blohm Gesellschaft mit beschraenkter Haftung, Munich, Fed. Rep. of Germany

[21] Appl. No.: 187,783

[22] Filed: Sep. 16, 1980

[30] Foreign Application Priority Data

Sep. 28, 1979 [DE] Fed. Rep. of Germany ..... 2939360

[51] Int. Cl.[3] ..... B31F 1/07; B44B 5/00; B21F 45/00; B41F 13/56

[52] U.S. Cl. ..... 101/11; 140/93 R; 101/227

[58] Field of Search ..... 174/112, 72 A; 178/DIG. 21; 29/729, 745; 140/93 R; 101/228, 11, 4, 29, 35, 37, 44

[56] References Cited

U.S. PATENT DOCUMENTS

| | | | |
|---|---|---|---|
| 2,517,493 | 8/1950 | Kingsley | 101/4 X |
| 2,973,706 | 3/1961 | Kingsley | 101/11 |
| 3,827,358 | 8/1974 | Budai | 101/228 |
| 4,023,482 | 5/1977 | Swett et al. | 101/29 X |
| 4,030,527 | 6/1977 | Roch | 140/93 R X |

*Primary Examiner*—Clifford D. Crowder
*Assistant Examiner*—David J. Isabella
*Attorney, Agent, or Firm*—W. G. Fasse; D. H. Kane, Jr.; D. F. Gould

[57] ABSTRACT

Cable harnesses are manufactured with a so-called cable head arranged on a cable laying carriage. The cable head is controlled by an electronic data processor and continuously lays a cable running off a coil or spool, about pins on a cable laying table or pallet. A plurality of such coils or spools are mounted in a cable magazine arranged for cooperation with said cable laying table. Any one of the cables on the coils may be drawn into the cable head which is equipped with cable marking tools and with cable buffer tools. The cable being laid is marked and for this purpose it is "buffered" to such an extent, that a dwell time is obtained sufficient for the marking operation. The buffering takes place first to form a loop. The cable length stored in the loop is used up during the marking so as not to interrupt the feed advance of the cable during its marking.

9 Claims, 7 Drawing Figures

Fig.4
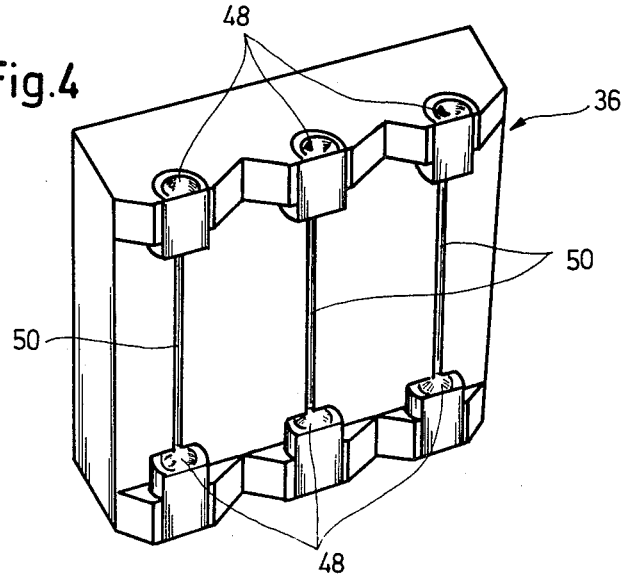
Fig.5
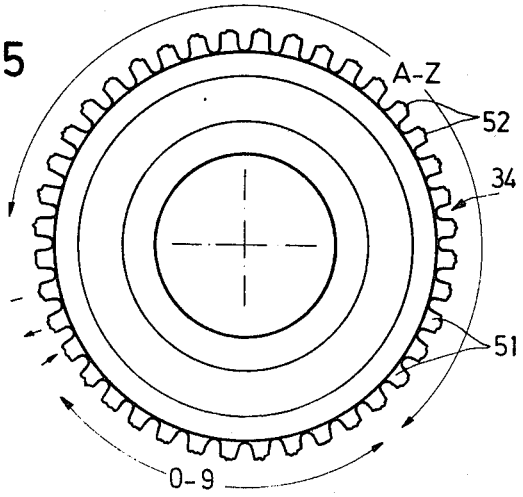
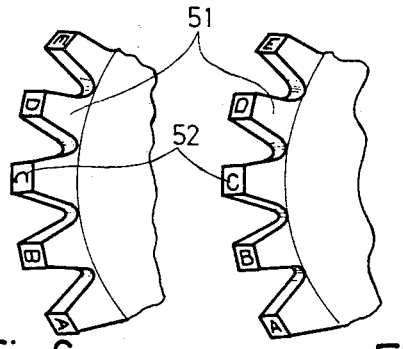
Fig.6
Fig.7

APPARATUS FOR MANUFACTURING CABLE HARNESSES AND PRINTER THEREFOR

CROSS REFERENCE TO RELATED APPLICATION

The present application is based on German Patent Application P No. 29 39 360.0; filed in the Federal Republic of Germany on Sept. 28, 1979. The priority of the German filing date is hereby expressly claimed.

BACKGROUND OF THE INVENTION

The present invention relates to an apparatus for manufacturing cable harnesses. More specifically, the invention relates to an apparatus for assemblying cable harnesses by means of a so-called cable head which is supported on a cable laying carriage controlled by an electronic data processing system. The so controlled cable head continuously applies a cable automatically to pins located in a cable laying table top or pallet while the cable is reeling off from a coil or spool in a continuous manner.

The magazine "Interavia" Number 8, 1977, page 822 describes a mounting apparatus of the type summarized in the foregoing paragraph. According to the prior art apparatus it is possible to supply the so-called cable laying head which is computer controlled from merely a single cable spool or coil.

Furthermore, the known apparatus does not comprise any device for the marking or labelling of the cable as it is being laid into a harness formation.

Further, if it is necessary to install in the harness a cable of another size or diameter, it becomes necessary to exchange the cable coil or spool. Further, since no marking means are provided, the only distinction between different cables can be made by employing cables having different colors. A marking of the individual cable harnesses must later be accomplished manually after the cable harness has been assembled.

OBJECTS OF THE INVENTION

In view of the above it is the aim of the invention to achieve the following objects singly or in combination:

- to provide a cable harness assemblying apparatus capable of operating in a continuous manner even if cables of different sizes or diameters are to be assembled into the harness without interruption of the manufacturing sequence;
- to provide a cable harness manufacturing apparatus capable of marking the individual cables or harnesses as they are being assembled; and
- to substantially reduce the time necessary heretofore for assemblying and marking cable harnesses.

SUMMARY OF THE INVENTION

According to the invention there is provided a manufacturing apparatus for making cable harnesses or for assemblying cables into a harness by means of a cable head controlled by electronic data processing means. The cable head is movable on a table top by means of a carriage and automatically takes up a cable running off a spool or coil to lay the cable about pins extending from the table top. A cable magazine carrying several spools is arranged for cooperation with the cable laying table. A selected cable is supplied to the cable laying head on the carriage. The cable laying head is provided with a device for marking and with a device for buffering the cables. The marking device marks the cable on its surface with markings and the buffering device is so arranged relative to the marking device that the cable is buffered prior to its marking or labelling by at least such an extent, preferably in a direction extending perpendicularly to the travel direction of the cable, that the resulting dwell time is sufficient for the operation of marking the cable.

The term "buffering" in this context means that a certain length of cable is diverted out of the normal feed advance direction of the cable to a predetermined extent so that the diversion results in a dwell time sufficient for the cable marking.

The main advantage of the invention is seen in that cables having a uniform coloring, preferably a white coloring, may be marked synchronously by means of the cable laying head and that a cable having different diameters or thicknesses or different types of cables may be directly withdrawn from the cable magazine carrying a plurality of cable coils of different types, whereby these different cables may be assembled into the harness in unison without interruption of the assemblying operation. It has been found that an apparatus according to the invention reduces the assemblying time required heretofore for the marking and assemblying of the cables into respective harnesses by more than 50%. Further advantages of the invention are apparent from the following detailed disclosure.

BRIEF FIGURE DESCRIPTION

In order that the invention may be clearly understood, it will now be described, by way of example, with reference to the accompanying drawings, wherein:

FIG. 4 shows a perspective view of a counter holding member also referred to as an embossing prism for marking a cable and for guiding cables of different diameters;

FIG. 5 is a side view of a marking wheel;

FIG. 6 shows a detail of a marking wheel with the marks, for example, in the form of letters oriented in the axial direction of the marking wheel; and FIG. 7 is a view similar to that of FIG. 6, but showing the markings oriented in the circumferential direction of the marking wheel.

DETAILED DESCRIPTION OF PREFERRED EXAMPLE EMBODIMENTS AND OF THE BEST MODE OF THE INVENTION

Figure 1:
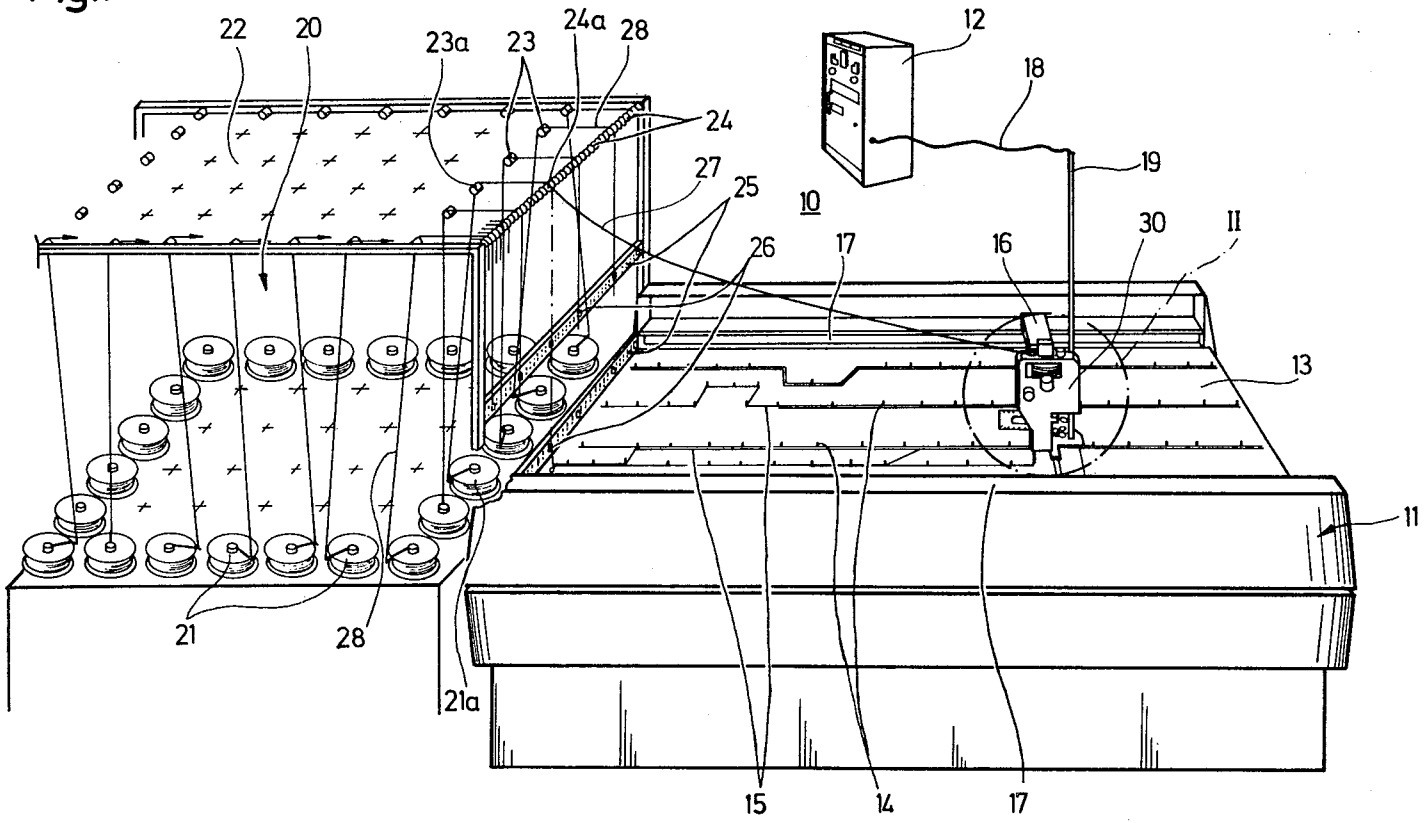
FIG. 1 is a simplified, perspective view of a cable assemblying apparatus according to the invention.

FIG. 1 shows a perspective over view of a cable harness assemblying apparatus 10 comprising a cable laying table 11 with a pallet 13 arranged for cooperation with a cable magazine 20. A so-called cable head 30 is movable back and forth along a rail 32 constituting one rectangular coordinate. For this purpose the cable head 30 is mounted on a carriage 16 which in turn is movable back and forth along the rail 32. Further, the rail 32 is movable in a direction extending perpendicularly to its longitudinal extent. For this purpose each end of the rail 32 is movable on rollers in respective guide tracks 17 along the length of the table 11 or pallet 13. The operation of the cable laying head 30 and its movements are automatically controlled by a control apparatus 12 which may be a programmed data processing device, for example, of the type "Jahnke MDU-Steuerung HF 212.85.1-16."

However, the data processing control device is not part of the present invention and therefore not described in detail.

The cable laying table 11 supports the table top or pallet 13 provided with pins 14 extending perpendicularly and upwardly out of the pallet 13 in a predetermined, well known pattern. The cable laying head 30 assembles the cable harnesses 15 about these pins 14 from which the assembled harnesses are subsequently removed. As mentioned, the carriage 16 is movable across the table top 13 in the direction of the rail 32 which in turn is movable horizontally lengthwise of the table top. The cable laying head 30 is operatively connected through a control and supply cable 18 extending, for example through a pipe 19 for controlling and energizing the cable laying head 30.

Only the essential components of the cable magazine 20 are illustrated in FIG. 1. The cable magazine carries a plurality of rows of cable coils or spools 21 for all required cable diameters and different types of cables. A so-called cable tower 22 forms part of the cable magazine or is arranged for cooperation therewith. The cable tower carries a feed advance motor 23 for each of the coils or spools 21. These feed advance motors 23 transport the respective cable by reeling the cable off the spool or coil and supplying the cable through guide rollers 24 to the cable head 30. In order to securely guide the cables, there are provided two cable clamping rods 25. One cable clamping rod 25 is arranged about halfway down the cable tower and the other is arranged at its bottom. Each cable clamping rod 25 is equipped with cable clamping clips 26. One clip is provided for each spool or coil. The just described elements constitute cable guide means which are arranged on the table tower facing the cable laying table 11. For example, a cable 27 is reeled off the coil 21*a* by means of a respective feed advance motor 23, whereby the cable 27 runs over a guide roller 24*a* to the cable head 30. The remaining cables 28 are held in readiness whereby their free ends are held by the respective cable guide clips 26 secured to the upper mentioned cable guide rods 25.

FIGS. 2 to 7 illustrate the details of the cable head 30. The cable head 30 comprises a housing 31 in or on which are assembled all the essential components of the cable head. The housing 31 is secured to a cable carriage 16 movable on the above mentioned rail 32 back and forth across the longitudinal extension of the cable laying table 11. The following components are assembled in or to the housing 31 in an order descending from the top downwardly. Thus, a cable guide and hold down roller 33 is secured to the top of the housing 31. Below the roller 33 there are arranged cable marking means including a set of marking wheels 34 as an integral part of the cable head 30. The marking wheels 34 may be automatically adjusted by means of an adjustment motor 35 arranged on the housing 31 behind the assembly of the roller 33. Counter holding means including a counter holder member or embossing prism 36 and a stroke cylinder 37 for the counter holder member 36 are arranged for cooperation with the marking wheels 34. The counter holder member 36 is illustrated in more detail in FIG. 4 and forms part of the marking means.

Figure 3:
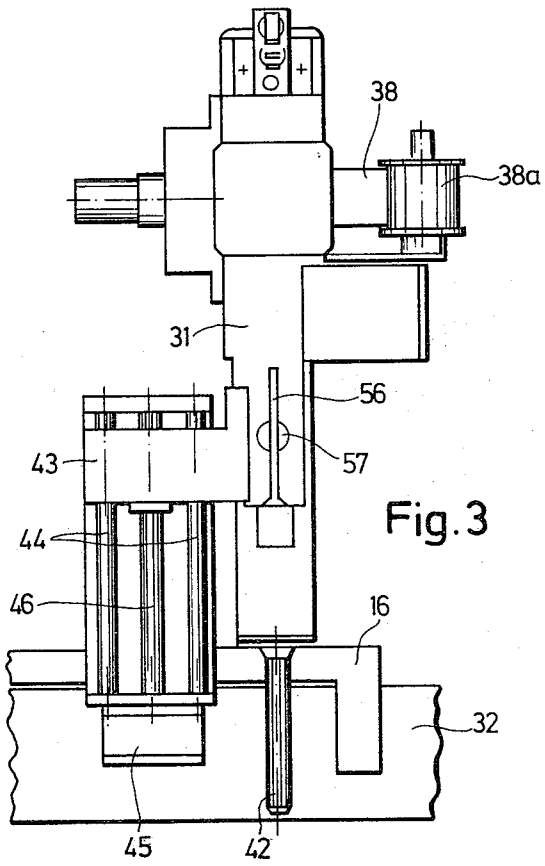
FIG. 3 is a front view of the cable laying head as viewed in the direction of the arrow A in FIG. 2.

The so-called counter holder member 36 is moved by the stroke piston cylinder arrangement 37 against the marking members of the wheels 34 to cause the marking of the cables as will be described in more detail below. An inking ribbon 38 is operatively arranged between the embossing prism or counter holder 36 and the marking wheels 34. The inking ribbon 38 is reeled off and taken up by rollers 38*a*, one of which is shown in FIG. 3. A cable buffering means or device 40 to be described in more detail below is operatively arranged in the housing 31 below the just described marking means or device. A cable laying finger 42 is secured to the lower end of the housing 31. The housing 31 is secured to the carriage 16 by means of a guide console or bracket 43. The entire housing 31 of the cable laying head 30 is movable vertically up and down along guide columns 44 by means of a rotatable spindle 46 cooperating with a threaded nut secured to the bracket 43. A stepping motor 45 rotates the spindle 46 for the vertical up and down adjustment of the cable laying head 30, please see FIG. 3.

Figure 2:
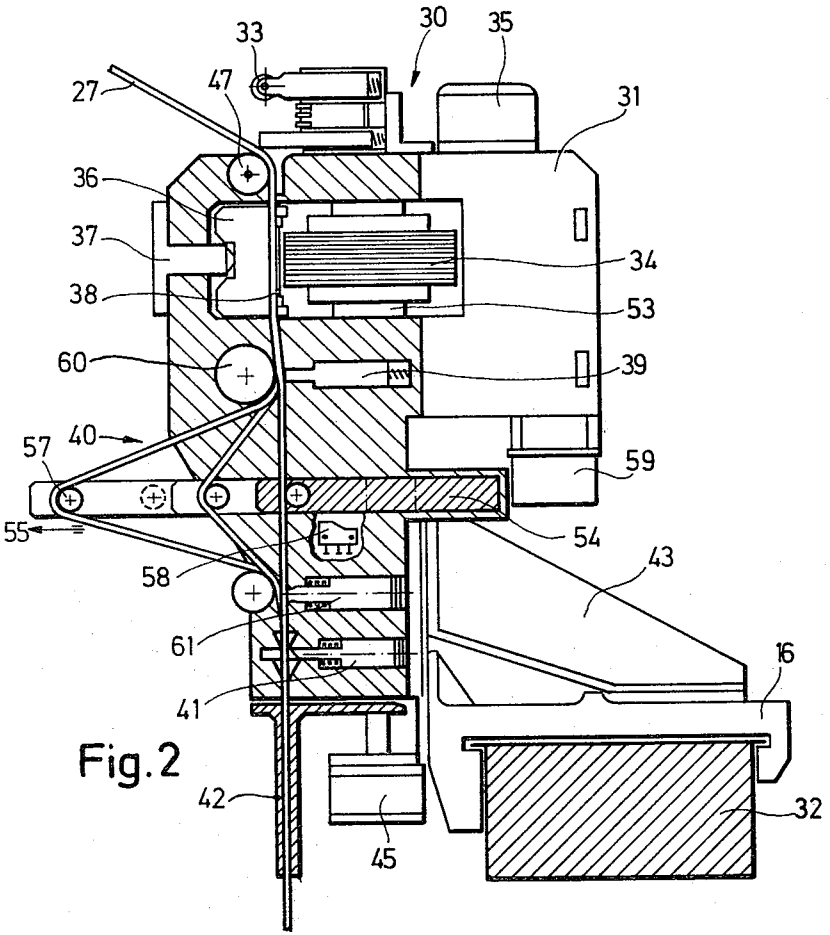
FIG. 2 illustrates a side view, partially in section, of a cable laying head according to the invention.

In operation, the cable 27, for example, is withdrawn from the cable magazine 20 in accordance with a program stored in the data processing control device 12. The cable 27 first runs over a guide roller 47 into the cable head, then passes entirely through the work stations described above in the head 30 and down through the laying finger 42 which guides the cable about the pins 14 in a known manner. Thus, the main feed advance direction runs from the roller 47 downwardly through the finger 42 as best seen in FIG. 2. Depending on the cable diameter, the cable 27 runs first through one of the different bores 48 of the embossing counter holder 36 shown in detail in FIG. 4. The embossing prism 36 comprises a plurality of guide bores 48 of different diameters. A pair of such bores 48 is respectively axially aligned and interconnected by counter holders 15 having a prism type shape. The embossing prism 36 is adjustable in its position in the housing 31 in a direction extending perpendicularly to the plane of the drawing in FIG. 2. Such adjustment means are conventional and hence not shown in detail. Thus, the embossing prism 36 may be placed into an operating position with any one of the axially aligned guide bores 48.

Ten marking wheels 34 forming a stack are arranged opposite the embossing prism 36. Details of the wheels 34 are shown in FIGS. 5 to 7. Each marking wheel 34 is provided around its circumference with forty teeth 51. Thirty-nine teeth are provided with marking elements 52, namely, the twenty-six letters of the alphabet, the numerals 0 to 9, a hyphen, and two oppositely directed arrows. One tooth remains empty.

As shown in FIGS. 6 and 7 two possible example embodiments of the arrangement of the marks 52, for example, the letters A to E on the teeth 51 are illustrated. For automatically adjusting the wheels 34 individually for the marking of the cable 27 to achieve any desired or required combination of the marking elements 52, the wheels 34 are provided with gear wheels not shown which are driven by the adjustment motor 35. During the adjustment of one wheel the others are arrested in a fixed position. Such wheel adjustments are well known in the art and hence not described in more detail. After all marking wheels 34 have been individually adjusted, they are arrested in unison by a servomotor 59.

For performing a marking operation on the cable 27 the embossing member or prism 36 is pressed against the inking ribbon 38 and against the adjusted marking wheels 34 to cause an impression on the cable 27. Preferably, a heating means 53 illustrated schematically may be provided in the respective bore for assuring a permanent marking on the cable.

In order to perform the marking operation it is necessary to interrupt the continuous feed advance of the cable 27 on the pallets 13 for a length of time sufficient for the marking operation. According to the invention the required dwell time is accomplished in that the cable 27 is buffered in the sense explained above, by means of a buffering device or means 40 arranged downstream of said cable laying head 30, more specifically downstream of said cable marking means, as viewed in said main feed advance direction and as shown in FIG. 2.

Prior to the marking of the cable 27, that is prior to the operation of the above described marking or labelling means, the cable buffering means or device 40 is operated by shifting a piston type member 54 to the left in the direction of the arrow 55 to form a cable loop 27'. The piston 54 is guided in a cylinder 54' and may be operated by any conventional means. The piston member 54 has a slot 56' at its left end. A cable guide roller 57 is located in the slot 56' and the latter is vertically aligned with a slot 56 in the housing 31 all as best seen in FIGS. 2 and 3. The cable 27 is guided in the slots 56 and 56' and by the roller 57 when it forms the loop 27'. Three positions of the piston member 54 are shown in FIG. 2. In the full line position the piston member 54 is fully retracted into the cylinder 54' and no cable loop is formed. In an intermediate position a smaller cable loop is shown and in the fully extended position a larger cable loop 27' is formed. When the piston member 54 is in the leftmost position it triggers a micro-switch 58 which in turn closes the necessary circuit for activating the cable marking means and the magnetic valve 39 for pressing the cable by means of the presser cylinder means 37 and the embossing member 36 against the teeth of the wheels 34. This takes place during the dwell time provided by the cable loop 27'. A feed advance motor 60 makes sure that during the buffering when the loop 27' is formed the feed advance exceeds the normal feed advance of the cable outside the loop. During this time the cable laying proceeds continuously on the cable pallet or table top 13. The dwell time required for the cable marking corresponds exactly to the time provided by using up the loop. In other words, the loop 27' is first formed, then the marking operation takes place during which marking time the loop 27' is used up. For using up the loop the cylinder member 54 travels in the right direction opposite to that indicated by the arrow 55. Thereafter the cable 27 again travels with a uniform speed through the cable laying head 30.

At the end of a cable harness 15, the laying operation of a new cable harness may proceed without interruption if the same type or diameter of cable 27 is used. Merely the wheels 34 would be adjusted and the cable does not even need to be severed. However, if another type or diameter of cable 28 is to be used, the cable 27 is severed by means of a cable cutter 41 after actuation of a hold down piston cylinder arrangement 61 which, for example, may be actuated by a solenoid and may be returned into a withdrawn position by a spring. The cable cutter 41 may be actuated and returned in a similar manner. The new cable 28 is taken up by the cable laying head 30 which is moved for this purpose to the tower 20 on the carriage 16 for receiving the end of the cable 28 from a cable clip 26. As mentioned, all these operations are under the control of the control device 12 which is programmed accordingly.

Although the invention has been described with reference to specific example embodiments, it will be appreciated, that it is intended, to cover all modifications and equivalents within the scope of the appended claims.

What is claimed is:

1. A mounting apparatus for continuously manufacturing a cable harness including a plurality of initially unmarked cables, comprising table means including a table top and pin means extending from the table top, cable coil magazine means arranged at one side of said table means for holding a plurality of cable coils and for cooperation with said table means, program controllable cable laying head means, carriage means for supporting said cable laying head means on said table means, said magazine means comprising means for feeding a cable in a main feed advance direction from any one of said cable coils toward and through said cable laying head means, said cable laying head means comprising as an integral part thereof means for marking a cable and means for buffering a cable, said buffering means being arranged downstream of said cable marking means as viewed in said main feed advance direction and means for moving said buffering means in a direction extending substantially perpendicularly to said main feed advance direction of a cable being laid, to such an extent that a length of cable is buffered to form a loop prior to its marking which loop provides a dwell time sufficient for said marking which thus takes place as part of the continuous cable harness manufacturing with a continuous cable feed advance.

2. The apparatus of claim 1, wherein said means for feeding comprise cable tower means arranged for operation between said cable coil magazine means and said table means, said cable tower means comprising guide roller means for guiding cables from said cable coils to said cable laying head, and cable securing means (25, 26) forming part of said cable tower means, said cable securing means (25, 26) holding cable ends ready for take-over by the cable laying head or as a beginning of a cable harness.

3. The apparatus of claim 1 or 2, wherein said cable laying head means comprise cable guide and pressing roller means arranged to be effective in the cable feed-through direction, cable cutting means forming part of said marking means, and a cable displacement finger forming part of said buffering means.

4. The apparatus of claim 1, wherein said marking means comprise a plurality of marking wheels arranged in a stack, each wheel comprising marking members and means for individually adjusting the position of each wheel in a stack, and counter presser means (36, 37) arranged for cooperation with the marking members for marking a cable, said marking means further comprising marking ribbon means interposed between said marking wheels and said counter presser means, said counter presser means including a counter holder member having different guide bores for cables of respectively different diameters.

5. The apparatus of claim 4, wherein said means for individually adjusting each marking wheel are automatically adjustable, said marking means further comprising heating means arranged for heating said marking wheels.

6. The apparatus of claim 1, wherein said means for buffering a cable comprise feed advance drive means (60) for a cable, piston cylinder means (54) of which the piston is movable in a direction extending substantially perpendicularly to the feed advance direction of a cable, switch means (58) for triggering a cable marking operation, and magnetic valve means (39) operatively arranged for holding a cable during said dwell time for performing a marking operation.

7. The apparatus of claim 4, wherein said marking members of each marking wheel are distributed on the circumference of the respective wheel in the form of marking teeth provided with the letters A to Z, numerals 0 to 9, a hyphen, two oppositely directed arrows, and a blank tooth.

8. The apparatus of claim 2, further comprising control means connected to said carriage means for moving the carriage means toward said cable tower means in accordance with a given operational sequence for automatically taking up a cable, threading a cable into the cable laying head means, and for moving the cable in the directions on and above said table means.

9. A program controllable cable laying head for continuously manufacturing a cable harness including a plurality of initially unmarked cables, comprising means (33, 47) for guiding a cable through said cable laying head in a given feed advance direction, cable marking means (34, 36) forming integral components of said cable laying head, cable buffering means also forming integral components of said cable laying head, said cable buffering means being arranged downstream of said cable marking means as viewed in said feed advance direction, and cable laying finger means arranged downstream of said cable buffering means, said cable buffering means forming a loop of a length of cable downstream of said cable marking means which loop is sufficient to provide a dwell time required for a marking operation whereby the marking takes place as part of the continuous cable harness manufacturing with a continuous cable feed advance, said cable laying head further comprising as an integral part thereof means for moving said cable buffering means in a direction extending substantially perpendicularly to said feed advance direction.

* * * * *